US005407139A

United States Patent [19]

Mleczewski

[11] Patent Number: 5,407,139

[45] Date of Patent: Apr. 18, 1995

[54] METHOD AND APPARATUS FOR DISPERSING AND METERING FIBERS

[75] Inventor: Terry L. Mleczewski, Scotts, Mich.

[73] Assignee: Interfibe Corporation, Portage, Mich.

[21] Appl. No.: 38,514

[22] Filed: Mar. 29, 1993

[51] Int. Cl.[6] ..... B02C 23/24; B65G 53/40

[52] U.S. Cl. ..... 241/18; 241/60; 241/101.8; 222/227; 222/236; 222/254; 366/10; 404/92; 406/41; 406/52; 406/53; 406/56; 406/104; 406/121; 406/124; 406/135; 406/140; 406/151; 406/155; 406/163

[58] Field of Search ..... 406/39, 41, 52, 53, 406/55, 56, 57, 58, 61, 102, 104, 121, 122, 124, 135, 139, 140, 151, 155, 157, 163, 168, 175, 197, 198; 222/145, 227, 236, 238, 254; 404/92; 198/533, 671; 366/3, 10, 23, 24, 30, 40, 42; 19/65 R, 65 A, 82; 241/18, 60, 101.8

[56] References Cited

U.S. PATENT DOCUMENTS

| | | | |
|---|---|---|---|
| 2,194,487 | 3/1940 | Thompson | 406/104 X |
| 2,941,841 | 6/1960 | Davis | 406/135 |
| 3,120,980 | 2/1964 | Kempthorne | 406/53 X |
| 3,529,870 | 9/1970 | Woten | 406/53 |
| 3,819,291 | 6/1974 | McConnaughay | 404/75 |
| 4,211,490 | 7/1980 | Brock et al. | 366/12 X |
| 4,236,654 | 12/1980 | Mello | 222/238 |
| 4,433,946 | 2/1984 | Christianson et al. | 406/43 |
| 4,613,376 | 9/1986 | Nilsson et al. | 106/232 |
| 4,968,188 | 11/1990 | Lucassen | 406/70 |
| 5,028,266 | 7/1991 | Rettenmaier | 106/282 |
| 5,160,222 | 11/1992 | Noland | 406/124 |
| 5,248,228 | 9/1993 | Giardina | 406/56 |

*Primary Examiner*—Andrew C. Pike
*Attorney, Agent, or Firm*—Flynn, Thiel, Boutell & Tanis

[57] ABSTRACT

A device for dispersing and metering fibers which includes a frame, and a hopper mounted on the frame and having an inlet opening for receiving fibers therein. A screen is provided through which the fibers from the inlet opening must pass for separating any existing fiber clumps into a size not exceeding a size predetermined by the screen. A primary fluffing device is provided for creating a uniform dispersion of fibers within the hopper. An outlet opening is provided for allowing the fibers to exit the hopper. A controllable metering device is provided in the outlet opening for transporting a metered quantity of fibers out of the hopper through the outlet opening. A housing structure is connected to an outlet end of the metering device, the housing structure including an air inlet opening into the housing and a secondary fluffing device inside of the housing for further reducing in size any fiber clumps to separated discreet fibers. An air impeller device is provided for moving a large volume of air into the air inlet opening and through the housing to effectively entrain the discreet fibers in a moving air stream and moving the air with the fibers entrained therein to an outlet connected to an asphalt cement and fiber mixer.

19 Claims, 3 Drawing Sheets

METHOD AND APPARATUS FOR DISPERSING AND METERING FIBERS

FIELD OF THE INVENTION

This invention relates to a method and an apparatus for dispersing and metering fibers and, more particularly, to a method and an apparatus for uniformly dispersing and metering cellulose fibers in an asphalt drum or batch plant.

BACKGROUND OF THE INVENTION

It is commonly known and accepted that cellulose fibers can be mechanically reduced to essentially separate fibers by several physical means, such as pulverizing, shredding, grinding, and the like. Several novel uses have been found for these ground fibers as a raw material in such products (but not limited to) as roofing coatings, textured paints, sound deadeners, driveway sealants, and the like. Fibers used in these applications are semi-dispersed, but usually their total separation is not required.

Another use which is rapidly gaining acceptance is the incorporation of a low level of fibers in asphaltic products used in the construction of highways. Asphalt-aggregate mixtures have been used worldwide for many years as road pavements, because of a plentiful supply and relatively low cost. Over the years, a number of modifications have been made in manufacturing and installation techniques, such as the addition of binding materials, various gradations of sand, gravel and the like. Despite these improvements, the trade is constantly seeking ways to improve the longevity of the product.

An extensive evaluation of highways in place in several foreign countries by a panel of construction engineers from the United States in 1990 revealed the use of a product, primarily in Europe, which provides a dramatic increase in the performance of asphalt pavements. It is called Stone Mastic Asphalt, also known as SMA. In general terms, an SMA is a gap-graded aggregate mix design containing approximately 6% asphalt and an asphalt modifier. The modifier is typically either a polymer or fiber. European roads using these mixes have performed very favorably.

The fibers, at a 0.3% level, exert a thixotropic or thickening on the asphalt, and stabilize the asphalt in the mix. This allows an acceptable viscosity to be maintained with a higher concentration of asphalt than could otherwise be used.

There are inherent problems in introducing loose fibers into a drum or batch plant. The low density of the fibers causes them to remain airborne without special equipment modifications. The present state of the art in Europe is to circumvent this problem by utilizing a pelleted product consisting of 50% cellulose fibers intimately mixed with 50% bitumen (asphalt), see U.S. Pat. No. 5,028,266. This allows for controlled addition of the fibers by adding the preformed pellet of substantial density into the hot mix, where it theoretically melts and uniformly disperses. This practice apparently works adequately; however, an inherent cost is obvious in the preparation and transportation of the pelleted mixture.

SUMMARY OF THE INVENTION

Accordingly, it is an object of the invention to allow for the shipment of lightweight containers of fibers for injection directly into the machinery for making asphalt.

It is a further object of this invention to provide a method and apparatus for dispersing and metering fibers in such a manner that a regulated rate of fibers is dispersed and metered to an outlet and for use in asphalt-making machinery, the presence of clumps of fibers not being present being assured.

It is a further object of this invention to provide a method and apparatus for dispersing and metering fibers, as aforesaid, wherein discreet fibers are air entrained and introduced into an asphalt-mixing device which includes a fiber inlet port with structure for cascading the asphaltic mix past the fiber inlet port to immediately coat and entrap all of the discreet fibers in the asphaltic mix so that the discreet fibers will be uniformly coated and blended into the asphaltic mix.

It is a further object of this invention to provide a method and an apparatus for dispersing and mixing fibers, as aforesaid, wherein the coating and entrapment of the discreet fibers into the asphaltic mix prevents loose fibers from becoming airborne and contaminating the working environment.

It is a further object of this invention to provide a method and an apparatus for dispersing and metering fibers, as aforesaid, wherein compressed bundles of fibers are initially utilized which become broken up into discreet fibers by plural fluffing steps and by passing the discreet fibers through an impeller means which effects the movement of a large volume of air and effects an air entrainment of the discreet fibers for delivery to an outlet from the device.

It is a further object of the invention to provide a method and an apparatus for dispersing and metering fibers, as aforesaid, wherein the methodology and apparatus are mobile and, therefore, capable of being transported from one working site to another.

It is a further object of this invention to provide a method and an apparatus for dispersing and metering fibers, as aforesaid, wherein the outlet of the device is connected to a fiber inlet port on either an asphalt drum plant or an asphalt batch plant.

It is a further object of the invention to provide a method and an apparatus for dispersing and mixing fibers, as aforesaid, wherein the asphalt present in the asphalt drum plant or asphalt batch plant is directed, while it is being mixed, past the fiber inlet port so that the individual fibers each become coated and entrapped in the asphaltic mix and uniformly blended therein without any fibers becoming airborne and contaminating the local environment.

It is a further object of the invention to provide a method and an apparatus for dispersing and metering fibers, as aforesaid, which is simple to operate and easy to maintain and is durably constructed.

The aforementioned objects and purposes of the invention are met by providing a device for dispersing and metering fibers which includes a frame, and a hopper mounted on the frame and having an inlet opening for receiving fibers therein. A screen is provided through which the fibers from the inlet opening must pass for separating any existing fiber clumps into a size not exceeding a size predetermined by the screen. A primary fluffing device is provided for creating a uniform dispersion of fibers within the hopper. An outlet opening is provided for allowing the fibers to exit the hopper. A controllable metering device is provided in the outlet opening for transporting a metered quantity of fibers out of the hopper through the outlet opening. A housing structure is connected to an outlet end of the metering device, the housing structure including an air inlet opening into the housing and a secondary fluffing device inside of the housing for further reducing in size any fiber clumps to separated discreet fibers. An air impeller device is provided for moving a large volume of air into the air inlet opening and through the housing to effectively entrain the discreet fibers in a moving air stream and moving the air with the fibers entrained therein to an outlet therefrom.

BRIEF DESCRIPTION OF THE DRAWINGS

Further objects and purposes of this invention will be apparent to persons acquainted with apparatus of this general type upon reading the following specification and inspecting the accompanying drawings, in which.

DETAILED DESCRIPTION

Figure 1:
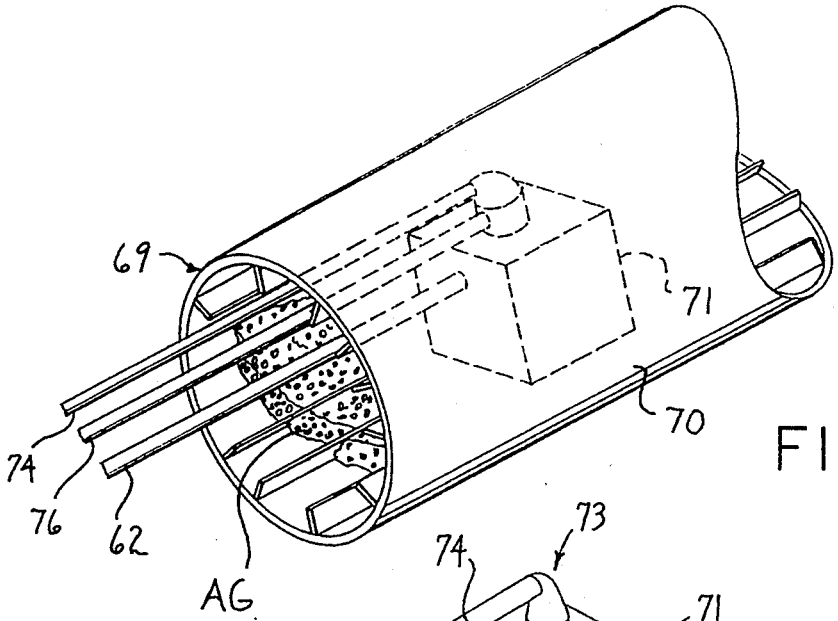
FIG. 1 is an isometric view of a fragment of an asphalt drum plant having the inventive fiber, asphalt cement, and bitumen inlet housing embodied therein.

Certain terminology will be used in the following description for convenience in reference only and will not be limiting The words "up", "down", "right", and "left" will designate directions in the drawings to which reference is made. The words "forwardly" and "rearwardly" will refer to the direction of material flow through the device, forwardly being the normal flow direction. The words "in" and "out" will refer to directions toward and away from, respectively, the geometric center of the device and designated parts thereof. Such terminology will include the words above specifically mentioned, derivatives thereof and words of similar import.

Figure 2:
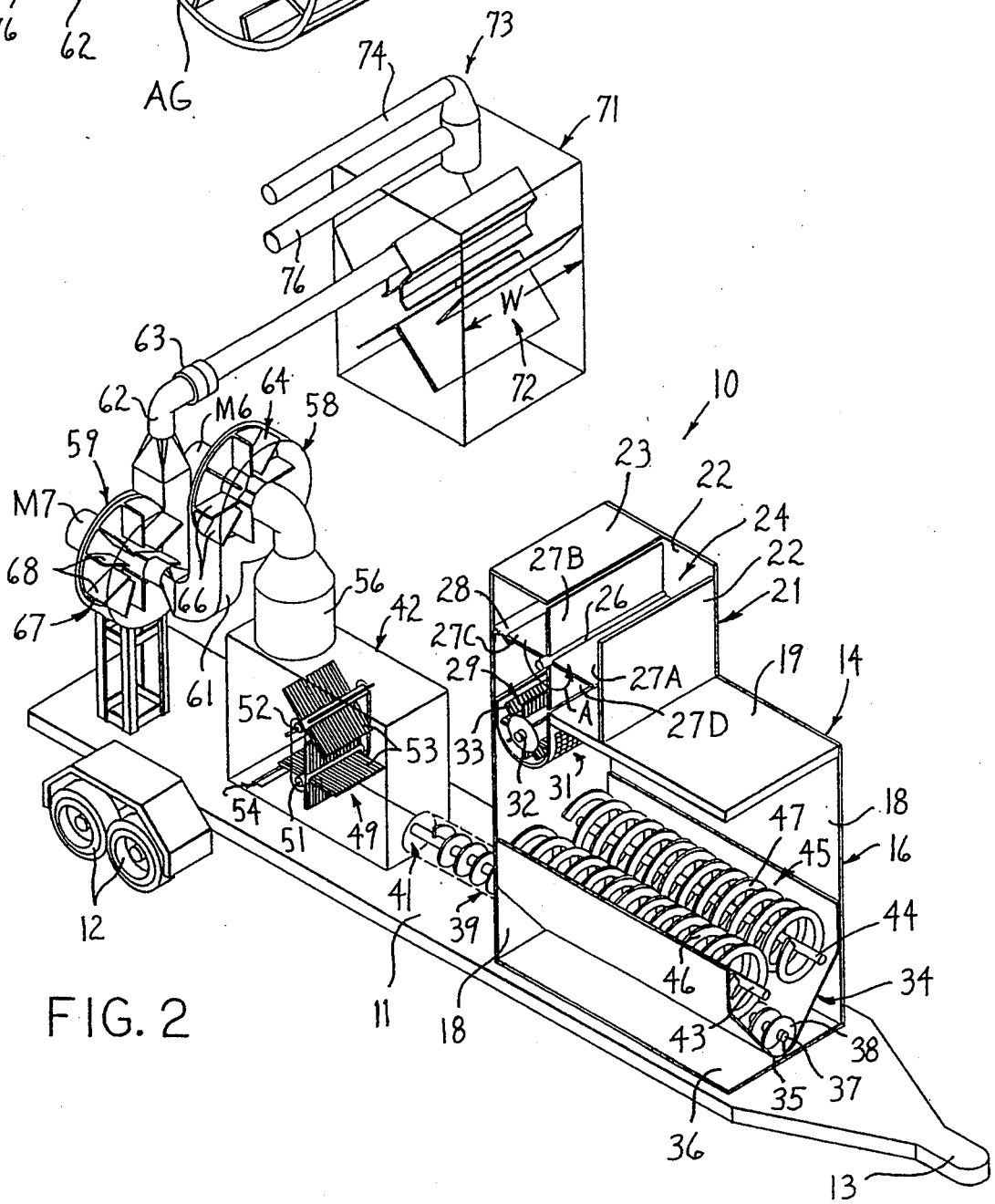
FIG. 2 is an isometric view of a trailerized apparatus for dispersing and mixing fibers, the outlet therefrom being connected to a fiber coating and entrapping hood oriented in a flow path of aggregate moving through an asphalt drum plant.

FIG. 2 is a highly schematic version of a device 10 for dispersing and metering fibers mounted on a trailer 11 supported on wheels 12 and capable of being hitched via a hitch structure 13 to a motorized vehicle (not illustrated). The device 10 includes a hopper generally designated at 14. The hopper includes a housing 16 mounted on the upper surface of the trailer 11 and includes a plurality of upstanding sidewalls 18, only two of which are illustrated in FIG. 2, and a top wall 19. In this particular embodiment, the top wall 19 is of sufficient strength to enable a person to stand thereon and for purposes which will become apparent below. In order for the person to get up onto the surface 19, a ladder or the like (not illustrated) is provided on one of the sidewalls 18 to enable the person to climb up onto the surface 19. A material inlet chute 21 is mounted on the top wall 19 and includes a plurality of upstanding sidewalls 22, only two of which are illustrated, and an upper part of a sidewall 18 of the hopper housing 16. A partial top wall 23 closes off a portion of the material inlet chute leaving a material inlet opening 24. A removable cover (not illustrated) is provided for covering the material inlet opening 24 during times that the apparatus is operating.

Figure 3:
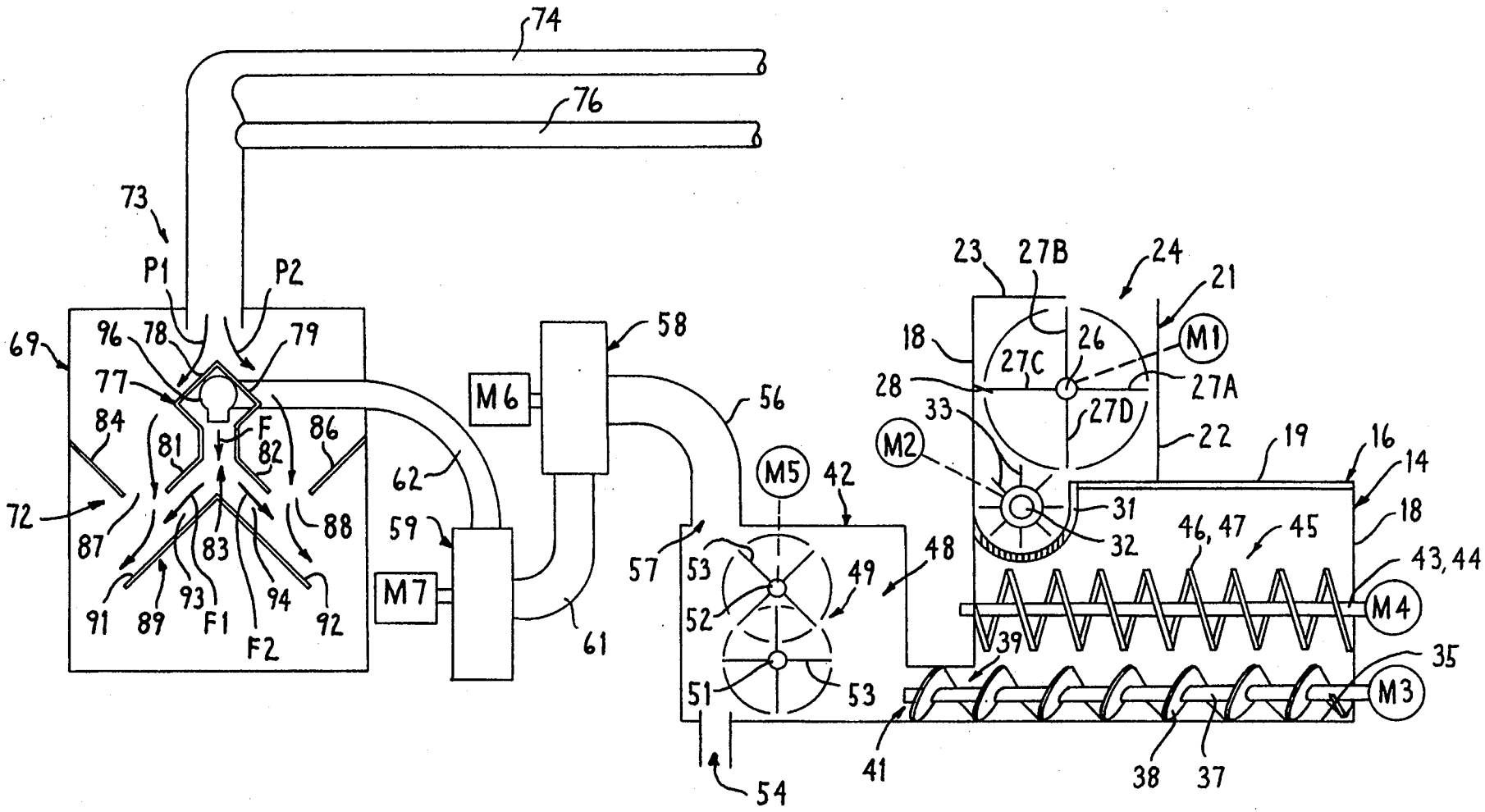
FIG. 3 is a schematic side elevational view of the structure illustrated in FIG. 2.

The material inlet chute 21 has a horizontal shaft 26 supported therein, which horizontal shaft is driven for rotation by a motor M1 schematically illustrated in FIG. 3. A plurality of circumferentially spaced, flat planar plates 27A–27D are fixedly secured to the shaft 26 and move therewith in the direction of the arrow A illustrated in FIG. 2. The motor M1 is preferably indexed for quarter turns so that following an activation thereof, the motor M1 will move the shaft ¼ revolution. As a result, bundled cellulose fibers which are generally compressed and which must be uncompressed are introduced into the material inlet opening 24 and rest on the upper surface of the plate 27A. The plates 27A–27D each move in the direction of the arrow A upon an activation of the motor M1 to cause each plate 27A to 27D to move past a flexible seal 28 which effectively prevents the premature falling of compressed fibers from the upper surface of the plate 27C, for example, past the seal 28.

The material inlet chute 21 further includes a space or gap 29 between the top wall 19 and one of the sidewalls 18 of the hopper housing 16 most remote from the top wall 19. The space or gap 29 includes a U-shaped screen 31 secured at the distal ends of the legs of the U to the top wall 19 and the mutually adjacent sidewall 18 of the hopper housing 16 that is most remote from the top wall 19. The ends of the screen 31 are blocked by corresponding sidewalls 18 (not illustrated) of the hopper housing 16. Between the legs of the U defined by the screen 31 there is provided a horizontally extending shaft 32, the axis of which extends generally parallel to an axis of the shaft 26. A plurality of blades 33 are secured to the shaft 32. There are from 2 to 48 blades 33 (optimally from 12 to 15 blades) from 6 inches to 24 inches in length (optimally about 12 inches in length) mounted to the shaft 32 and are constructed of steel or any other suitably rigid material. A motor M2, schematically illustrated in FIG. 3, is provided for driving the shaft 32 and blades 33 for rotation. The speed of the motor M2 is in the range of from 2 r.p.m. to 2,000 r.p.m. (optimally about 750 r.p.m.). The rotating blades 33 pass through the clumped, packed cellulose fiber material and serve to separate the clumps so that they will be in condition to enter and pass through the screen 31. The screen 31 has uniform perforations therethrough of from 1/24 inch to 2.0 inches round in diameter, preferably about 1 inch in diameter, located as close to each other as is structurally acceptable. The screen 31 covers the entire space or gap 29 so that all of the fibers must pass through the screen 31 and assures that no clumps of fibers larger than the size of the holes in the screen will be present after the fibers pass through the screen. In addition, the actual passage of the loosened clumps through the holes in the screen will serve to further cause the clumps to disintegrate. Gravity is the sole means of fiber delivery through the screen. There is no propulsion of the fibers through the screen from any external air.

A generally V-shaped trough 34 is provided at the base of the hopper housing 16, the apex 35 of the V being secured to a bottom wall 36 of the hopper housing 16, which bottom wall 36 is secured to the upper surface of the trailer 11. An elongated shaft 37 is oriented above and parallel to the apex 35 of the V-shaped trough 34 and has a screw flight 38 secured thereto for rotation therewith. The shaft 37 is driven by a variable speed motor M3 schematically illustrated in FIG. 3. The screw flights 38 serve, upon rotation of the shaft 37, to auger fibers gathering at the apex of the trough 34 toward a tubular outlet opening 39 leading from the hopper housing 16 and connected to a tubular inlet opening 41 of a further housing 42. A pair of laterally spaced rotatable shafts 43 and 44 are synchronously rotated by either a single motor M4 schematically illustrated in FIG. 3 or by separate motors. The shafts 43 and 44 are each connected to a ribbon blending blade structure 46 and 47, respectively, to define a primary fluffing structure 45 inside the hopper housing 16. The shafts 43 and 44, when rotated, cause the fibers to essentially traverse the circumference of the hopper to provide a uniform dispersion of the fibers. The speed of rotation of the motor M4 should be from 1 r.p.m to 200 r.p.m., optimally 100 r.p.m. The fluffed fibers eventually are drawn downwardly by the screw auger or conveyor 37, 38. In this particular embodiment, the screw conveyor 37, 38 is oriented centrally below the shafts 43 and 44 and, further, the shaft 37 extends parallel to the shafts 43 and 44. Further, the rotation of the shaft 37 can be the same as or opposite to the rotation of the shafts 43 and 44.

The speed of rotation of the shaft 37 is controlled by the speed of rotation of the variable speed motor M3 which effects a precise monitoring of the feed rate of fibers into the outlet opening 39. As the fibrous material enters the inlet opening 41 to the further housing 42, the expansive space 48 within the housing 42 constitutes a "decompression" area for the fibers This decompression area provides an equalizing effect on the flow rate, removing feed irregularities inherent in a screw-auger feed mechanism and allowing the fibers to enter a secondary fluffing mechanism 49 which comprises a pair of vertically spaced, horizontally extending, shafts 51 and 52 rotatably mounted on the sidewalls of the housing 42 and driven for synchronous rotation by a single motor M5, schematically illustrated in FIG. 3. Each of the shafts 51 and 52 have a plurality of tines 53 mounted thereon and have a length of from 1 inch to 24 inches in length, preferably about 10 inches long. The shafts are each rotated at a speed of about 1 r.p.m. to 1,000 r.p.m., preferably about 100 r.p.m. The tines move between the spaces of mutually adjacent tines on an adjacent shaft so that the fibers entering the inlet opening 41 must pass between the tines. An air inlet opening 54 is provided in a bottom wall of the housing 42 and is oriented on a side of the tines 53 remote from the inlet opening 41.

An outlet conduit 56 is coupled to the interior of the housing 42 and on a wall spaced from the air inlet opening 54. In this particular embodiment, the inlet opening 57 to the conduit 56 is oriented vertically above the air inlet 54 to the housing 42. The conduit 56 is coupled to a pair of series connected blowers 58 and 59. The blower 58 is driven by a motor M6 whereas the blower 59 is driven by a motor M7. The outlet of the blower 58 is connected by means of a conduit 61 to the air inlet to the blower 59. The outlet from the blower 59 is connected by means of a conduit 62 to a fiber outlet port 63. The blower 58 includes an air impeller 64 rotatably driven by the motor M6. The air impeller 64 includes a plurality of peripherally spaced blades 66, each of which blades 66 draw air into the inlet of the blower 58 and forcibly eject the air into the conduit 61. Similarly, the blower 59 includes an air impeller 67 having a plurality of peripherally spaced blades 68 for drawing air into the inlet of the blower 59 and forcibly ejecting same out through the conduit 62 and thence to the fiber outlet port 63.

As the fibers move through the secondary fluffer mechanism 49, the fibers which are not yet totally separated into discreet fibers are rapidly entrained into an airstream entering the air inlet 54 and carried out through the air outlet opening 57 into the conduit 56 and thence through the blowers 58 and 59. As the fibers impinge upon the blades 66 and 68 of the air impeller structures 64 and 67, respectively, the fibers will become separate and discreet as they are delivered to the fiber outlet port 63. The airstream should be sufficient to carry from ten to several hundred pounds of fibers per minute. This final impingement of the fibers on to the blades 66 and 68 of the air impeller structure 64 and 67, respectively, causes the fibers to be totally separated by air so as to render the fibers ready for delivery to the fiber outlet port 63.

FIGS. 1, 2 and 3 schematically illustrate an asphalt drum plant 69. A typical asphalt drum plant 69 generally includes an elongated and rotating cylindrical drum 70 through which aggregate AG is tumbled, moved lengthwise from one end of the drum toward the other and heated to effect a drying of the aggregate. Since the cylindrical drum 70 is well known in the art, it is only schematically shown in FIG. 1. A fiber, asphalt cement and bitumen housing 71 is oriented inside the drum 70 approximately one-half to three-fourths of the way from the aggregate inlet toward the outlet. The housing 71 has a plurality of baffles 72 therein for facilitating the mixing of asphalt cement and hot bitumen entering an inlet conduit 73 through pipes 74 and 76. In this particular embodiment, the baffle system 72 includes an inverted generally U-shaped baffle 77 located directly beneath the inlet conduit 73. The U-shaped baffle 77 includes a pair of diverging surfaces 78 and 79 for splitting the asphalt cement and hot bitumen mix into two flow paths P1 and P2. The baffle 77 also includes a pair of deflecting surfaces 81 and 82 at the distal end of the legs of the U for deflecting the asphalt cement and bitumen mix laterally away from an opening 83 between the distal end of the legs of the U-shaped baffle 77. Laterally spaced from the baffles 81 and 82 are a further set of baffles 84 and 86 which, in combination with the baffles 81 and 82, form a funnel-like construction forcing the asphalt cement and hot bitumen mix in the flow path P1 to exit between the baffles 81 and 84 through an opening 87 and the material in the flow path P2 to engage the baffle surfaces 82 and 86 and exit through an opening 88. A still further inverted V-shaped baffle 89 having oppositely inclined surfaces 91 and 92 thereon is provided with the apex being oriented directly beneath the opening 83 between the distal end of the legs of the U-shaped baffle 77. The surfaces 91 and 92 are each located beneath an associated one of the openings 87 and 88. As a result, the asphalt cement and hot bitumen mix in the flow paths P1 and P2 will exit the openings 87 and 88, as aforesaid, and engage surfaces 91 and 92, respectively, of the V-shaped baffle 89. Other baffling may be present in the housing 71. However, the more important baffling is shown in FIGS. 2 and 3 for directing the asphalt cement and hot bitumen mix through the split-apart flow paths P1 and P2. The space between the underside of the deflectors 81 and 82 and the upwardly facing baffle surfaces 91 and 92 each define an outlet opening 93 and 94, respectively. The flow paths P1 and P2 flow past the outlet openings 93 and 94 and, due to the downwardly inclined slope of the baffle surfaces 91 and 92, the mix will flow away from the outlet openings 93 and 94.

A fiber inlet pipe 96 is mounted inside the inverted U-shaped baffle plate 77, which fiber inlet pipe has a plurality of openings along the length thereof, which openings are directed to the opening 83 between the distal ends of the legs of the U-shaped baffle 77. The fiber inlet pipe 96 is connected to the fiber outlet port 63 of the dispersing and metering device 10 so that the air entrained fibers exiting the fiber outlet port 63 will exit the fiber inlet pipe 96 through the aforesaid longitudinally spaced openings therein. The air entrained fibers F will be split into two separate flow paths F1 and F2 when they engage the apex portion of the inverted V-shaped baffle 89 and be caused to flow out through the fiber outlet openings 93 and 94. Since the asphalt cement and hot bitumen mix moving along the flow paths P1 and P2 is continuous across the width dimension W of the housing 71, the air entrained fibers in the flow paths F1 and F2 will be coated and entrapped within the mix at the junctures between the flow paths P1 and F1 as well as the junctures between the flow paths P2 and F2. Since the fibers are discreet fibers, they will be coated and entrapped into the mix and further blended by other baffling not illustrated in the housing 71. The asphalt cement, hot bitumen, and fiber mix will exit the housing 71 from the lower open end and enter into the continuously moving stream of aggregate AG moving lengthwise of the drum 69. The tumbling action of the aggregate AG in the drum 69 will blend the fibers, hot bitumen, and asphalt cement mix evenly throughout the aggregate AG. Thus, by monitoring the weight throughput of aggregate through the asphalt drum plant 69 per unit of time with the weight of cellulose fibers moving through the dispersing and metering device 10 per the same unit of time, an accurate measure of the percentage of fiber in the asphalt mix can be accurately monitored.

EXAMPLE

Asphalt production trials proceeded at 200 ton/hr., incorporating cellulose at 0.3% and asphalt cement at 6.2 and 6.7%. The material was produced and laid on site for heavy load exposure and observation. Under the observation of Michigan DOT officials, final calculations revealed 278 tons of asphalt were produced; 1,640 lbs. of cellulose fibers were added to the hopper, with 0.295% cellulose in the finished product (Target: 0.300%). Initial and final samples were taken from the dust collection system at various points and examined microscopically for the presence of cellulose fibers. None were found, indicating that the fibers were not entering the dust collection system.

FIRST ALTERNATE EMBODIMENT

Figure 4:
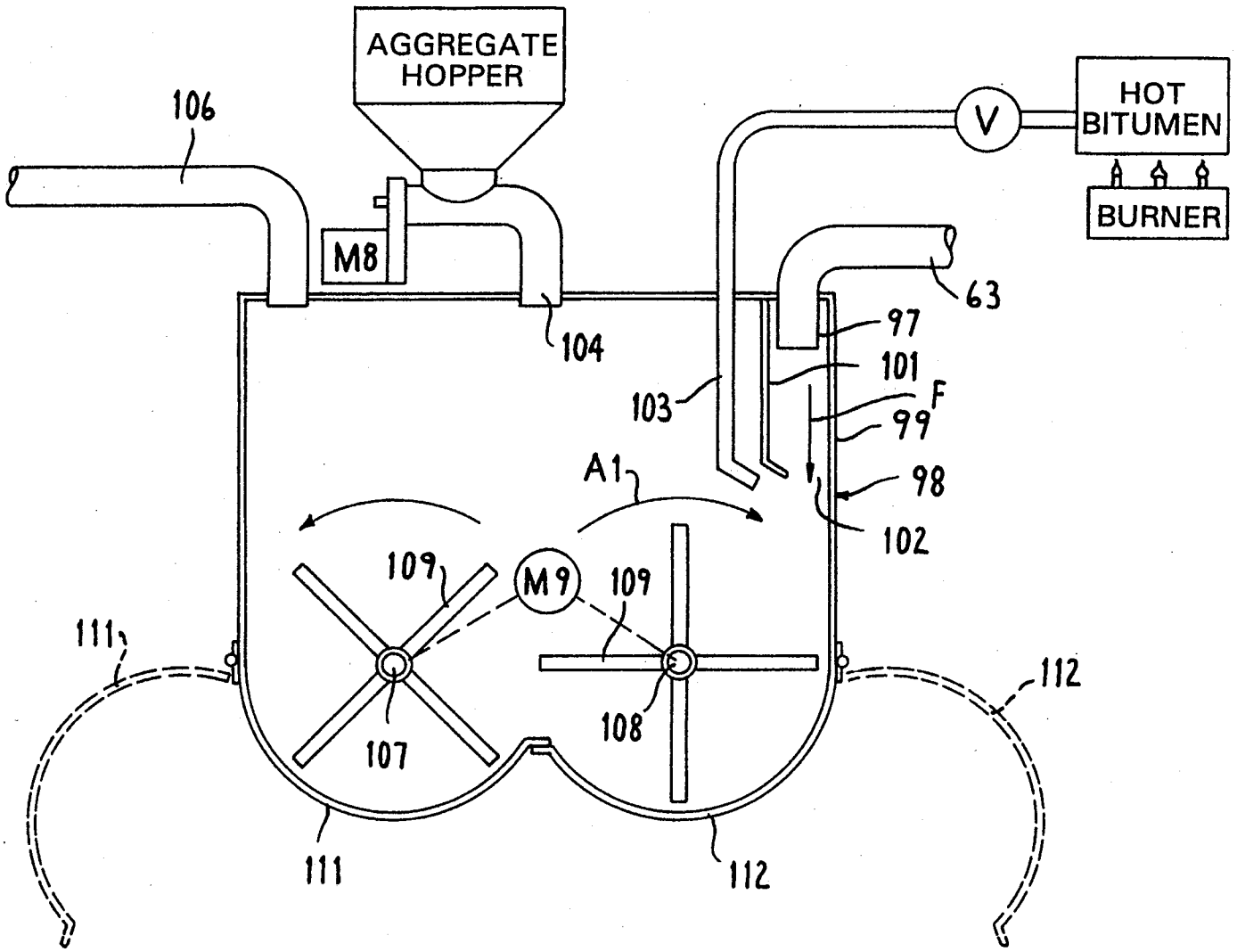
FIG. 4 is a schematic side elevational view of the connection of the outlet of the dispersing and metering device to the fiber inlet port in an asphalt batch plant.

FIG. 4 illustrates a connection of the fiber outlet port 63 to a fiber inlet port 97 of an asphalt batch plant 98. The asphalt batch plant 98 includes a housing 99 having on the inside thereof a baffle plate 101 shielding the fiber inlet port 97 from any asphalt mix present in the batch plant 98 so that airborne fibers entering the fiber inlet port 97 will be free to move along a flow path F to a fiber outlet opening 102. In this particular embodiment, hot bitumen and asphalt cement enters the batch plant 98 through a pipe 103 whereas aggregate enters the batch plant through an aggregate inlet pipe 104. Any gases that may be present inside the batch plant 98 can be drawn out of the batch plant through an exhaust pipe 106. A valve V in the asphalt cement and hot bitumen pipe 103 regulates the batch volume of asphalt cement and hot bitumen entering the batch plant 98. An appropriate control of a motor M8 regulates the batch volume of aggregate entering the inlet pipe 104. The batch plant includes, in this particular embodiment, a pair of rotating side-by-side shafts 107 and 108, each shaft having a plurality of tines 109 thereon for mixing the aggregate and bitumen in the batch plant. The shafts 107 and 108 are rotatably driven by a motor M9. A pair of pivotal gates 111 and 112 are oriented directly beneath the shafts 107 and 108 so that following a complete mixing of the asphalt cement and hot bitumen and aggregate in the batch plant 98, the entire batch may be dumped when the pivotal gates 111 and 112 are pivoted to the broken line position illustrated in FIG. 4. Of particular importance in this particular embodiment is the introduction of airborne fibers into the aggregate, asphalt cement, and hot bitumen mix adjacent the fiber outlet opening 102. Generally, the aggregate, asphalt cement, and hot bitumen mix will be blended by the tines 109 and the mix adjacent the fiber inlet opening 102 will be generally moving in the direction of the arrow A1. Further, the fill level of the aggregate, asphalt cement, and bitumen mix in the batch plant will likely be above the fiber outlet opening 102 so that the air-entrained fibers will be promptly coated and trapped in the mix as the mix moves generally in the direction of the arrow A1 past the fiber outlet opening 102. As a result, discreet fibers will be evenly distributed in the asphalt mix as aforesaid.

SECOND ALTERNATE EMBODIMENT

The embodiment of FIGS. 2 and 3 illustrate the provision of a material inlet opening 24 into which bundled and compressed cellulose fibers is introduced. This means that the packaging for the bundled and compressed cellulose fibers must be first lifted to the level of the top wall 19, opened, and then dumped into the material inlet opening 24 by an operator standing on the top wall 19 of the hopper housing 16. An alternate embodiment replaces the material inlet opening 24 and inlet chute 21 and rotatable shaft 26 and associated structure with an inclined auger, not illustrated, extending from an inlet end at a level generally equal 10 to the top surface of the trailer 11 up to the space 29 immediately above the screen 31 so that it will not be necessary for an operator to climb up onto the top wall surface 19 of the hopper housing 16. Instead, the operator will be able to stand on the ground adjacent the trailer 11 and place the bundled and compressed cellulose fibers into the inlet end of an auger chute and the auger will effect a partial breaking up of the compressed cellulose bundle and a movement of the cellulose fibers up to and into the space 29 immediately above the shaft 32 and the screen 31.

Although particular preferred embodiments of the invention have been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. A device for dispersing and metering fibers comprising:

a frame;

a hopper mounted on said frame and having an inlet means for receiving the fibers, a screen means through which the fibers from said inlet means must pass for separating any existing fiber clumps into a size not exceeding a size predetermined by said screen means, a primary fluffing means for providing a uniform dispersion of the fibers within said hopper, and an outlet means for allowing the fibers to exit said hopper;

a controllable metering means in said outlet means for transporting a metered quantity of the fibers out of said hopper through said outlet means;

a housing connected to an outlet end of said metering means, said housing including means defining an air inlet opening into said housing, and a secondary fluffing means inside of said housing for further reducing in size any fiber clumps to separated discreet fibers; and air impeller means for moving a large volume of air into said air inlet opening and through said housing to effectively entrain the discreet fibers in a moving air stream and moving said air with the discreet fibers entrained therein to an outlet therefrom, said outlet from said air impeller means including an asphalt cement and fiber mixing means adapted to receive the air-entrained discreet fibers therein, said asphalt cement and fiber mixing means including a fiber inlet port and cascading means for causing an asphaltic mix consisting of asphalt cement and hot bitumen to be cascaded past said fiber inlet port to immediately coat and entrap all of said discreet fibers in the asphaltic mix so that said discreet fibers will be uniformly blended into the asphaltic mix.

2. The device according to claim 1, wherein said cascading means includes a plurality of baffles for diverting a vertical flow of the asphaltic mix so as to create an enclosed space in the asphaltic mix; and wherein said fiber inlet port is located in said enclosed space so that the discreet air-entrained fibers are directly coated and entrapped in said vertical flow of the asphaltic mix so that a continued mixing of the asphaltic mix will result in a uniform distribution of said discreet fibers therein.

3. The device according to claim 2, wherein said asphalt cement and fiber mixing means is oriented in an asphalt drum plant.

4. The device according to claim 1, wherein said asphalt cement and fiber mixing means is oriented in an asphalt batch plant.

5. A device for dispersing and metering fibers comprising:

a frame;

a hopper mounted on said frame and having an inlet means for receiving the fibers, said inlet means including a preliminary fluffing means having a plurality of blades mounted on a rotatably supported shaft oriented in a path of said fibers entering said inlet means for preliminarily breaking up and fluffing the fibers, said blades being of equal length with the radially outer ends thereof describing a circle, a screen means through which the fibers from said preliminary fluffing means must pass for separating any existing fiber clumps into a size not exceeding a size predetermined by said screen means, said screen means including a screen arranged in an arc across said inlet means, a radius of said arc coinciding with an axis of rotation of said shaft, a primary fluffing means for providing a uniform dispersion of the fibers within said hopper, and an outlet means for allowing the fibers to exit said hopper;

a controllable metering means in said outlet means for transporting a metered quantity of the fibers out of said hopper through said outlet means;

a housing connected to an outlet end of said metering means, said housing including means defining an air inlet opening into said housing, and a secondary fluffing means inside of said housing for further reducing in size any fiber clumps to separated discreet fibers; and air impeller means for moving a large volume of air into said air inlet opening and through said housing to effectively entrain the discreet fibers in a moving air stream and moving said air with the discreet fibers entrained therein to an outlet therefrom.

6. The device according to claim 5, wherein said frame includes ground engaging wheels and support means therefor.

7. The device according to claim 6, wherein said frame further includes a hitch means for facilitating connection of said frame to a motorized vehicle.

8. The device according to claim 5, wherein said screen has uniform perforations of from 1/24 inches round to 2.0 inches round in diameter.

9. The device according to claim 8, wherein said perforations are 1 inch round in diameter.

10. The device according to claim 5, wherein said inlet means further includes a compartment and a further rotatable shaft therein, said further shaft having a plurality of paddles fixedly mounted on and extending radially outwardly therefrom so as to divide said compartment into a plurality of subchambers, a rotation of said further shaft causing said subchambers to sequentially move past said preliminary fluffing means to effect a transference of any fibers therein to said preliminary fluffing means, said paddles simultaneously effectively blocking an escape of the fibers from said preliminary fluffing means into the air surrounding said device.

11. A device for dispersing and metering fibers comprising:

a frame;

a hopper mounted on said frame and having an inlet means for receiving the fibers, a screen means through which the fibers from said inlet means must pass for separating any existing fiber clumps into a size not exceeding a size predetermined by said screen means, a primary fluffing means for providing a uniform dispersion of the fibers within said hopper, and an outlet means for allowing the fibers to exit said hopper;

a controllable metering means in said outlet means for transporting a metered quantity of the fibers out of said hopper through said outlet means;

a housing connected to an outlet end of said metering means, said housing including means defining an air inlet opening into said housing, and a secondary fluffing means inside of said housing for further reducing in size any fiber clumps to separated discreet fibers, said secondary fluffing means including a plurality of tines affixed to and extending radially outwardly from a pair of radially spaced shafts in said housing, said tines on one shaft moving between tines on the other shaft to reduce the fibers to the discreet fibers; and air impeller means for moving a large volume of air into said air inlet opening and through said housing to effectively entrain the discreet fibers in a moving air stream and moving said air with the discreet fibers entrained therein to an outlet therefrom.

12. The device according to claim 11, wherein said controllable metering means includes a tube through which a variable speed screw extends from said outlet means of said hopper to said housing which houses said secondary fluffing means therein, the speed of rotation of said variable speed screw being precisely controllable to thereby control the amount of fibers moving through the device.

13. The device according to claim 11, wherein said primary fluffing means includes a ribbon blender for fluffing the fibers in said hopper between said screen means and said outlet means from said hopper.

14. The device according to claim 11, wherein said frame includes ground engaging wheels and support means therefor.

15. The device according to claim 14, wherein said frame further includes a hitch means for facilitating connection of said frame to a motorized vehicle.

16. A device for dispersing and metering fibers comprising:

a frame;

a hopper mounted on said frame and having an inlet means for receiving the fibers, a screen means through which the fibers from said inlet means must pass for separating any existing fiber clumps into a size not exceeding a size predetermined by said screen means, a primary fluffing means for providing a uniform dispersion of the fibers within said hopper, and an outlet means for allowing the fibers to exit said hopper;

a controllable metering means in said outlet means for transporting a metered quantity of the fibers out of said hopper through said outlet means;

a housing connected to an outlet end of said metering means, said housing including means defining an air inlet opening into said housing, and a secondary fluffing means inside of said housing for further reducing in size any fiber clumps to separated discreet fibers; and air impeller means for moving a large volume of air into said air inlet opening and through said housing to effectively entrain the discreet fibers in a moving air stream and moving said air with the discreet fibers entrained therein to an outlet therefrom, said air impeller means including a pair of series connected impellers, the air-entrained discreet fibers moving through said impellers, impingement of the air-entrained fibers on the impellers further enhancing the separation of the fibers into the discreet air-entrained fibers.

17. The device according to claim 16, wherein said frame includes ground engaging wheels and support means therefor.

18. The device according to claim 17, wherein said frame further includes a hitch means for facilitating connection of said frame to a motorized vehicle.

19. A method for dispersing and metering fibers comprising the steps of:

introducing bundled and compressed fibers into an opening into a hopper;

breaking up any clumps of fibers in said compressed fibers into a predetermined maximum size by urging said compressed fibers through a screen having a plurality of predetermined sized openings therethrough and through which said fibers pass;

fluffing said fibers exiting said screen to create a uniform dispersion of fibers within said hopper;

removing said fibers in said hopper at a metered rate into a housing;

fluffing the fibers in said housing;

entraining the fibers metered from the hopper and fluffed in said housing into an air stream located upstream of a blower means;

passing the air-entrained fibers through the blower means so that air impeller means thereof will effect an enhanced delivery of discreet air,entrained fibers to an outlet; and injecting the discreet air-entrained fibers exiting the outlet into an enclosed space in an asphaltic mix so that the air-entrained, discreet fibers will be directly entrapped and a continued mixing of the asphaltic mix will result in a uniform distribution of the fibers therein.

* * * * *

UNITED STATES PATENT AND TRADEMARK OFFICE

CERTIFICATE OF CORRECTION

PATENT NO. : 5,407,139

DATED : April 18, 1995

INVENTOR(S) : Terry L. MLECZEWSKI

It is certified that error appears in the above-indentified patent and that said Letters Patent is hereby corrected as shown below:

Column 12, line 37; change "air,entrained"
to ---air-entrained---.

Signed and Sealed this

Thirty-first Day of October 1995

Bruce Lehman

*Attest:*

BRUCE LEHMAN

*Attesting Officer*

*Commissioner of Patents and Trademarks*